US006667281B2

(12) United States Patent
Ikejima et al.

(10) Patent No.: US 6,667,281 B2
(45) Date of Patent: Dec. 23, 2003

(54) GREASE COMPOSITION

(75) Inventors: Syouzou Ikejima, Okazaki (JP); Yasuyuki Wakahara, Kariya (JP); Hirotugu Kinoshita, Yokohama (JP); Kiyomi Sakamoto, Yokohama (JP)

(73) Assignees: Nippon Oil Corporation, Tokyo (JP); Denso Corporation, Aichi-Pref (JP)

( * ) Notice: Subject to any disclaimer, the term of this patent is extended or adjusted under 35 U.S.C. 154(b) by 0 days.

(21) Appl. No.: 09/967,622

(22) Filed: Sep. 28, 2001

(65) Prior Publication Data

US 2002/0072477 A1 Jun. 13, 2002

(30) Foreign Application Priority Data

Oct. 6, 2000 (JP) ..... 2000-307162

(51) Int. Cl.[7] ..... C10M 169/06

(52) U.S. Cl. ..... 508/181; 508/182; 508/258; 508/552

(58) Field of Search ..... 508/181, 182, 508/258, 552

(56) References Cited

U.S. PATENT DOCUMENTS

| | | | | |
|---|---|---|---|---|
| 4,256,591 | A | 3/1981 | Yamamoto et al. | 252/12 |
| 5,604,187 | A | 2/1997 | Takeuchi et al. | 508/168 |
| 6,444,621 | B1 * | 9/2002 | Okaniwa et al. | |

FOREIGN PATENT DOCUMENTS

| | | | |
|---|---|---|---|
| JP | 57-65797 | 4/1982 | C10M/7/30 |
| JP | 61-12791 | 1/1986 | C10M/111/00 |
| JP | 064665 | 3/2001 | C10M/169/06 |

* cited by examiner

*Primary Examiner*—Jerry D. Johnson
(74) *Attorney, Agent, or Firm*—Darby & Darby

(57) ABSTRACT

A grease composition suitable for use with vehicle electrical equipment and vehicle engine starters is disclosed, which has excellent abrasion resistance and anti-seizure property, long service life, excellent lubricity at low temperatures, and has no adverse effect on electric contacts. The composition contains: (A) a silicon-free synthetic oil having a kinematic viscosity of 10 to 60 $mm^2/s$ at 40° C.; (B) a urea thickener; (C) melamine cyanurate; and (D) polytetrafluoroethylene.

12 Claims, No Drawings

GREASE COMPOSITION

FIELD OF THE INVENTION

The present invention relates to a grease composition, in particular a grease composition that is used as a lubricant for gears and sliding parts. The present invention specifically relates to a grease composition that is excellent in lubricity even at low temperatures, abrasion resistance, and anti-seizure property, and is suitable for use with electrical equipment of marine engines, air craft engines, and vehicle engines, which require grease providing long service life, for example, starters including various sliding parts and gears such as helical gears, reduction gears, drive shafts, and levers.

BACKGROUND OF THE INVENTION

A starter for starting up marine engines, aircraft engines, and vehicle engines usually has a pinion gear, which is driven via an overrunning clutch by a drive shaft of a motor. Upon switching on the motor for start-up, a magnet coil is excited to cause a lever to slide the pinion gear toward a ring gear provided on the output shaft of an engine. The pinion gear then meshes with the ring gear to rotate and start up the engine.

An engine starter has various sliding parts and gears. For lubrication of such parts, greases are mainly used which contain a base grease composed of a lubricating base oil and a thickener such as a lithium soap, and additives such as molybdenum disulfide or molybdenum dithiocarbamate.

Greases for various engine starters are required to have properties to enable smooth start-up even at low temperatures (lubricity at low temperatures), abrasion resistance, anti-seizure property, heat resistance, and low friction. However, properties of conventional greases cannot keep up with the recent increase in frequency of engine starter activation due to the recent effort to stop idling of vehicle engines for reducing emission in the light of global environmental problems. Thus there is a strong demand for improvement in particularly abrasion resistance and anti-seizure property of greases in order to prolong their service life.

In addition, greases for engine starters are demanded that will not adversely affect the electric contacts of the engine starters.

SUMMARY OF THE INVENTION

It is therefore an object of the present invention to provide a grease composition that has excellent abrasion resistance and anti-seizure property, long service life, exhibits excellent lubricity even at low temperatures, and has no adverse effect on electric contacts.

It is another object of the present invention to provide a grease composition suitable for use with electrical equipment and engine starters of vehicles and the like, which has excellent abrasion resistance and anti-seizure property, long service life, exhibits excellent lubricity even at low temperatures, and has no adverse effect on electric contacts, as well as a method for lubricating a vehicle electrical equipment or an engine starter with this composition.

According to the present invention, there is provided a grease composition comprising:

(A) a silicon-free synthetic oil having a kinematic viscosity of 10 to 60 $mm^2/s$ at 40° C.;

(B) a urea thickener;

(C) melamine cyanurate; and (D) polytetrafluoroethylene.

According to the present invention, there is also provided a lubricating method comprising applying the above grease composition to a vehicle electrical equipment or an engine starter having an electric contact, or use of the grease composition.

PREFERRED EMBODIMENTS OF THE INVENTION

The present invention will now be explained in detail.

Component (A) of the present grease composition is a synthetic oil that contains no silicon and has a specific kinematic viscosity. Examples of such a silicon-free synthetic oil may include poly-α-olefins such as polybutene, 1-octene oligomer, and 1-decene oligomer, and hydrides thereof; diesters such as ditridecyl glutarate, di-2-ethylhexyl adipate, diisodecyl adipate, ditridecyl adipate, and di-3-ethylhexyl sebacate; polyol esters such as trimethylolpropane caprylate, trimethylolpropane pelargonate, pentaerythritol-2-ethylhexanoate, and pentaerythritol pelargonate; alkylnaphthalene; alkylbenzene; polyoxyalkylene glycol; polyphenyl ether; dialkyl diphenyl ether; and mixtures thereof. Among these examples, poly-α-olefins, diesters, polyol esters, and mixtures thereof are preferably used.

Synthetic oils containing silicon, such as silicon oil, which have adverse effect on electric contacts, cannot be used.

The kinematic viscosity of component (A) at 40° C. should be not lower than 10 $mm^2/s$, preferably not lower than 15 $mm^2/s$, for suppressing evaporation at elevated temperatures and for preventing solidification of the grease to achieve sufficiently long lubricating life, and should be not higher than 60 $mm^2/s$, preferably not higher than 50 mm2/s, for achieving sufficient lubricity at low temperatures.

As component (A), a mixture of a plurality of synthetic oils may be used, as long as the kinematic viscosity of the mixture falls within the above-mentioned range. It is not mandatory that each and every synthetic oil in the mixture has a kinematic viscosity within the range mentioned above. It is yet preferred, for giving the grease sufficient fluidity at low temperatures, that each and every synthetic oil in the mixture has a kinematic viscosity that falls within the above-mentioned range.

According to the present invention, the amount of component (A) contained in the grease composition is not particularly limited. However, in order to eliminate any possibility that the grease becomes too solid to exhibit sufficient lubricity, the content of component (A) is preferably not less than 50% by weight, more preferably not less than 60% by weight of the grease composition, and preferably not more than 95% by weight, more preferably not more than 90% by weight of the grease composition.

Component (A) constitute a base oil in the grease composition of the present invention. In addition to the synthetic oil of component (A), the base oil of the present grease composition may also contain a mineral oil, such as paraffin or naphthene oil, as long as the desired advantages of the present invention are achieved.

A mineral oil may have anadverse effect on electric contacts, and may impair the fluidity of the grease at low temperatures. Thus, the content of the mineral oil is preferably not more than 20% by weight, more preferably not more than 10% by weight of the grease composition, and most preferably, no mineral oil is contained in the grease composition.

The kinematic viscosity of the mineral oil is not particularly limited. However, for suppressing evaporation at higher temperatures and for preventing solidification of the grease to achieve sufficiently long lubricating life, the kinematic viscosity of the mineral oil at 40° C. is preferably not lower than 10 $mm^2/s$, more preferably not lower than 15 $mm^2/s$. On the other hand, for giving sufficient lubricity at low temperatures, the kinematic viscosity of the mineral oil is preferably not higher than 100 $mm^2/s$, more preferably not higher than 80 $mm^2/s$.

Component (B) of the present grease composition is a urea thickener. The urea thickener may be selected from, for example, urea compounds, urea-urethane compounds, urethane compounds, and mixtures thereof.

Examples of the urea compounds, urea-urethane compounds, and urethane compounds may include diurea compounds, triurea compounds, tetraurea compounds, polyurea compounds (other than di-, tri-, and tetraurea compounds), urea-urethane compounds, diurethane compounds, and mixtures thereof. Among these, diurea compounds, urea-urethane compounds, diurethane compounds, and mixtures thereof are particularly preferred.

More specifically, the urea thickener may preferably be a compound, or a mixture of compounds represented by the formula (1):

$$X—CONH—R^1—NHCO—Y \quad (1)$$

In the formula (1), $R^1$ stands for a divalent hydrocarbon group, and X and Y may be the same or different groups, each standing for $—NHR^2$, $—NR^3R^4$, or $—OR^5$, wherein $R^2$, $R^3$, $R^4$, and $R^5$ may be the same or different groups, each standing for a hydrocarbon group having 6 to 20 carbon atoms.

$R^1$ in the formula (1) is a divalent hydrocarbon group having preferably 6 to 20, more preferably 6 to 15 carbon atoms. Examples of the divalent hydrocarbon group may include a straight or branched alkylene group, a straight or branched alkenylene group, a cycloalkylene group, and an aromatic group. $R^1$ may specifically be an ethylene group, a 2,2-dimethyl-4-methylhexylene group, or one of the groups represented by the following formulae:

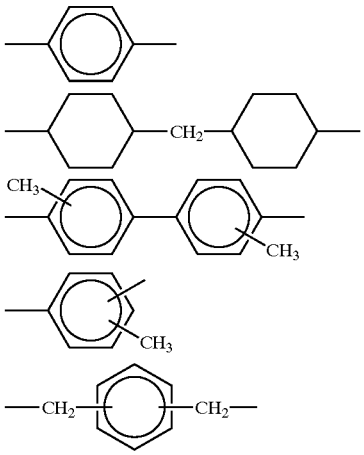

-continued

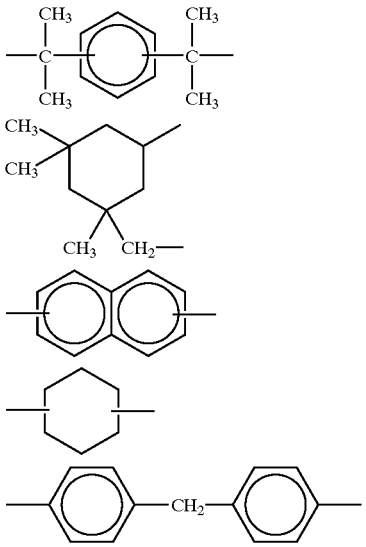

Among these, the following groups are particularly preferred:

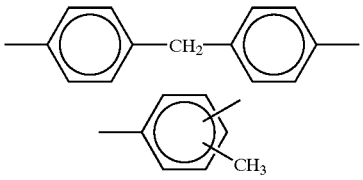

Each of $R^2$, $R^3$, $R^4$, and $R^5$ may be, for example, a straight or branched alkyl group, a straight or branched alkenyl group, a cycloalkyl group, an alkylcycloalkyl group, an aryl group, an alkylaryl group, or an arylalkyl group. More specific examples of these groups may include a straight or branched alkyl group such as a hexyl, heptyl, octyl, nonyl, decyl, undecyl, dodecyl, tridecyl, tetradecyl, pentadecyl, hexadecyl, heptadecyl, octadecyl, nonadecyl, or icosyl group; a straight or branched alkenyl group such as a hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, or eicosenyl group; a cyclohexyl group; an alkylcycloalkyl group such as a methylcyclohexyl, dimethylcyclohexyl, ethylcyclohexyl, diethylcyclohexyl, propylcyclohexyl, isopropylcyclohexyl, 1-methyl-3-propylcyclohexyl, butylcyclohexyl, amylcyclohexyl, amylmethylcyclohexyl, hexylcyclohexyl, heptylcyclohexyl, octylcyclohexyl, nonylcyclohexyl, decylcyclohexyl, undecylcyclohexyl, dodecylcyclohexyl, tridecylcyclohexyl, or tetradecylcyclohexyl group; an aryl group such as a phenyl or naphthyl group; an alkylaryl group such as a toluyl, ethylphenyl, xylyl, propylphenyl, cumenyl, methylnaphthyl, ethylnaphthyl, dimethylnaphthyl, or propylnaphthyl group; or an arylalkyl group such as a benzyl, methylbenzyl, or ethylbenzyl group. Among these, cyclohexyl, octadecyl, and toluyl groups are particularly preferred.

A diurea, urea-urethane, or diurethane compound as component (B) may be prepared by reacting a diisocyanate represented by the formula $OCN—R^1—NCO$ with a compound represented by the formula $R^2NH_2$, $R^3R^4NH$, or $R^5OH$, or a mixture thereof, in the base oil at 10 to 200° C., wherein $R^1$, $R^2$, $R^3$, $R^4$, and $R^5$ are the same as those in the formula (1).

According to the present invention, the amount of component (B) in the grease composition is not particularly limited. However, for exhibiting its effect as a thickener, component (B) is contained in an amount of preferably not less than 2% by weight, more preferably not less than 5% by weight of the grease composition. On the other hand, in order not to impair the lubricity of the grease, the content of component (B) is preferably not more than 30% by weight, more preferably not more than 20% by weight of the grease composition.

Component (C) of the present invention is melamine cyanurate. Component (C) is a product of an addition reaction between 1 mole of melamine and 1 mole of cyanuric acid or isocyanuric acid, and is in the form of white powders having cleavage like molybdenum disulfide and graphite, wherein melamine molecules with a six-membered ring structure are firmly bonded with cyanuric acid or isocyanuric acid molecules via hydrogen bonds in a plane to form a layer, and a plurality of such layers are weakly bonded with each other. The primary particle size of the white powders is usually 0.5 to 5 $\mu$m.

Component (C) may be prepared by any method. For example, component (C) may readily be obtained as a white precipitate by mixing an aqueous solution of melamine and an aqueous solution of cyanuric acid or isocyanuric acid. Component (C) may alternatively be prepared by reacting an aqueous dispersion of melamine and one or both of cyanuric acid and isocyanuric acid dispersed as the solid phase.

The content of component (C) is not particularly limited, and is preferably 0.1 to 20% by weight, more preferably 0.5 to 10% by weight of the grease composition.

Component (D) of the present grease composition is polytetrafluoroethylene.

Component (D) is in the form of white powders having a structure represented by the formula —($CF_2$—$CF_2$)n—, wherein carbon atoms and fluorine atoms are bonded by strong binding energy.

Component (D) may be powders known as molding powders that may be molded into various molded products, pipes, and sheets, or fine powders that may be obtained by suspension polymerization or emulsion polymerization, and has excellent heat resistance, chemical inertness, and low friction.

The amount of component (D) in the grease composition is not particularly limited, and may preferably be 0.1 to 20% by weight, more preferably 0.5 to 10% by weight of the grease composition.

The grease composition of the present invention may also contain, as desired for further improving its performance, a solid lubricant, an extreme pressure agent, an anti-oxidant, a metal deactivator, an oilness agent, a rust-inhibitor, a viscosity index improver, or mixtures thereof, as long as the properties of the composition are not impaired.

The solid lubricant may be selected from, for example, graphite, fluorinated carbon black, borates of alkali metals, borates of alkaline earth metals, magnesium oxide, or zinc oxide.

The extreme pressure agent may be selected from, for example, phosphates or phosphites.

The anti-oxidant may be selected from, for example, phenol compounds such as 2,6-di-t-butylphenol or 2,6-di-t-butyl-p-cresol; amine compounds such as dialkyldiphenylamine, phenyl-$\alpha$-naphthylamine, or palkylphenyl-$\alpha$-naphthylamine; or phenothiazine compounds.

The metal deactivator may be selected from, for example, benzotriazole, benzothiazole, or sodium nitrite.

The oilness agent maybe selected from, for example, amines such as laurylamine, myristylamine, palmitylamine, stearylamine, or oleylamine; higher alcohols such as lauryl alcohol, myristyl alcohol, palmityl alcohol, stearyl alcohol, or oleyl alcohol; higher fatty acids such as lauric acid, myristic acid, palmitic acid, stearic acid, or oleic acid; fatty acid esters such as methyl laurate, methyl myristate, methyl palmitate, methyl stearate, or methyl oleate; or amides such as laurylamide, myristylamide, palmitylamide, stearylamide, or oleylamide.

The rust-inhibitor may be selected from, for example, neutral or overbased petroleum or synthetic oil metal sulfonates such as neutral or overbased calcium sulfonates, neutral or overbased barium sulfonates, neutral or overbased zinc sulfonates; metal soaps; partially esterified polyhydric alcohols such as sorbitan fatty acid esters; amines; phosphoric acid; or phosphates.

The viscosity index improver may be selected from, for example, polymethacrylate, polyisobutylene, or polystylene.

It is of course not preferred to use any additives that may adversely affect the electric contacts.

Examples of such additives that may adversely affect the electric contacts may include molybdenum disulfide; metal dithiocarbamates such as molybdenum dithiocarbamate or zinc dithiocarbamate; metal dithiophosphates such as molybdenum dithiophosphate or zinc dithiophosphate; polysulfides; sulfur extreme pressure agents such as sulfurized oils and fats; or silicone defoaming agents.

There is no particular limitation imposed on the process for preparing the grease composition according to the present invention. For example, the grease composition may be prepared by adding, to the base lubricating oil of component (A), components (B), (C), and (D), and other additives if desired, stirring, and passing the resulting mixture through a roll mill or the like. Alternatively, the grease composition may also be prepared by adding and dissolving the starting material components for the thickener of component (B) in the base lubricating oil of component (A), stirring the resulting mixture to prepare component (B) in component (A), adding components (C) and (D) as well as other additives if desired, stirring, and passing the resulting mixture through a roll mill or the like.

The grease composition of the present invention is used as a lubricant for gears and sliding parts, and is particularly preferred for use with electrical equipment of marine engines, air craft engines, and vehicle engines, such as starters including various sliding parts and gears such as helical gears, reduction gears, drive shafts, and levers.

The grease composition of the present invention contains (A) a silicon-free synthetic oil having a specific kinematic viscosity, (B) a urea thickener, (C) melamine cyanurate, and (D) polytetrafluoroethylene, so that the composition has excellent abrasion resistance and anti-seizure property, long service life, and excellent lubricity even at low temperatures, and has no adverse effect on electric contacts. The present grease composition is thus particularly suitable for use with vehicle electrical equipment and vehicle engine starters.

EXAMPLES

The present invention will now be explained in further detail with reference to Examples and Comparative Examples, but the present invention is not limited to these.

Examples 1 and 2 and Comparative Examples 1 to 5

Diphenylmethane-4,4'-diisocyanate was dissolved in the base oils shown in Table 1 under heating, and mixed with cyclohexylamine previously dissolved in the same base oils under heating. The resulting gels were mixed with melamine cyanurate, polytetrafluoroethylene, and/or various additives as shown in Table 1, stirred, and passed through a roll mill to obtain grease compositions.

The resulting grease compositions were subjected to the following evaluations. The results are also shown in Table 1.

<Four-ball EP Test>

According to ASTM D2596, the weld load (WL) after a run under the specified load at 1800 rpm for 10 seconds was determined.

<SRV Friction Test>

A ball of 10 mm in diameter (upper specimen) was pressed against a disk (lower specimen) under the load of 100 N, and rubbed with an oscillating motion at a frequency of 10 Hz and stroke of 2 mm for 30 minutes. The wear trace size on the ball after the test was determined.

<Low Temperature Sliding Test>

The grease was applied over a clutch bearing and a drive shaft of a vehicle engine starter. The bearing and the shaft were assembled, placed in a constant temperature bath at −40° C. to cool for 2 hours, and taken out carefully. The assembly was fixed on a dedicated jig, and the load required for starting up the rotation of the drive shaft was determined.

<Thin Film Test>

The grease was applied over an iron plate of 80 mm by 60 mm, placed in a constant temperature bath at 120° C. for 200 hours, and taken out. The evaporation of the grease was calculated according to the following formula.

$$\text{Evaporation (wt \%)} = \frac{\text{Weight of grease before test (g)} - \text{Weight of grease after test (g)}}{\text{Weight of grease before test (g)}} \times 100$$

<Contact Voltage Drop at Electric Contacts>

A contact and the grease were sealed together in a glass container, and placed in a constant temperature bath at 150° C. for 500 hours. The contact was then taken out, and the contact voltage drop at 200 A was determined.

The results shown in Table 1 demonstrate that the grease compositions of Comparative Example 1 without component (D) and of Comparative Example 2 without component (C) have poor anti-seizure property; that the grease composition of Comparative Example 3 wherein the kinematic viscosity of component (A) at 40° C. exceeds 60 $mm^2/s$ has poor lubricity at low temperature; that the grease composition of Comparative Example 4 wherein the kinematic viscosity of component (A) at 40° C. is below 10 $mm^2/s$ has poor heat resistance; and that the grease composition of Comparative Example 5 which employs a lubricating base oil other than component (A) causes high contact voltage drop at electric contacts. In contrast to these grease compositions of Comparative Examples, the grease compositions according to the present invention exhibit excellent anti-seizure property, abrasion resistance, lubricity at low temperatures, and heat resistance. It is also demonstrated that the present grease compositions have no adverse effect on electric contacts.

Although the present invention has been described with reference to the preferred examples, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A method for lubricating a vehicle electrical equipment comprising applying a grease composition to at least one of sliding parts and gears of a vehicle electrical equipment having an electric contact, said grease composition comprising:

(A) a silicon-free synthetic oil having a kinematic viscosity of 10 to 60 $mm^2/s$ at 40° C.;

(B) a thickener selected from the group consisting of urea compounds, urea-urethane compounds, urethane compounds, and mixtures thereof;

(C) melamine cyanuarate; and (D) polytetrafluoroethylene, and free of molybdenum disulfide.

TABLE 1

| | | Examples | | Comparative Examples | | | | |
|---|---|---|---|---|---|---|---|---|
| | | 1 | 2 | 1 | 2 | 3 | 4 | 5 |
| Base oil (wt %) | Diester[1)] | 36.0 | — | 37.5 | 37.5 | — | — | — |
| | Poly-α-olefin | 36.0 | 74.0 | 37.5 | 37.5 | — | — | — |
| | Dialkyl diphenyl ether | — | — | — | — | 72.0 | — | — |
| | Diester[2)] | — | — | — | — | — | 72.0 | — |
| | Dimethyl silicon oil | — | — | — | — | — | — | 70.0 |
| Kinematic viscosity of base oil at 40° C. ($mm^2/s$) | | 25 | 45 | 25 | 25 | 100 | 9 | 40 |
| Thickener (wt %) | | 18.0 | 18.0 | 18.0 | 18.0 | 18.0 | 18.0 | 20.0 |
| Thickener (moler ratio) | Diphenylmethane-4,4'-diisocyanate | 2 | 2 | 2 | 2 | 2 | 2 | 2 |
| | Cyclohexylamine | 1 | 1 | 1 | 1 | 1 | 1 | 1 |
| Melamine cyanurate (wt %) | | 3.0 | 2.0 | 3.0 | — | 3.0 | 3.0 | 3.0 |
| Polytetrafluoroethylene (wt %) | | 3.0 | 4.0 | — | 3.0 | 3.0 | 3.0 | 3.0 |
| Anti-oxidant[3)] (wt %) | | 2.0 | 2.0 | 2.0 | 2.0 | 2.0 | 2.0 | 2.0 |
| Rust-inhibitor[4)] (wt %) | | 2.0 | 2.0 | 2.0 | 2.0 | 2.0 | 2.0 | 2.0 |
| Four-ball EP text, WL (N) | | 3923 | 3923 | 1236 | 1236 | — | — | — |
| SRV friction test, wear trace size ($mm^2$) | | 0.12 | 0.14 | 0.10 | 0.10 | — | — | — |
| Low temperature sliding test (gf) | | 700 | 900 | — | — | 1600≦ | 550 | 150 |
| Thin film test, evaporation (wt %) | | 8 | 4 | — | — | 3 | 47 | 1 |
| Contact voltage drop at electric contacts (V) | | 0.06 | 0.05 | 0.07 | 0.06 | 0.05 | 0.08 | 0.5 |

[1)]Diester (kinematic viscosity at 40° C.: 12 $mm^2/s$)
[2)]Diester (kinematic viscosity at 40° C.: 9 $mm^2/s$)
[3)]Amine anti-oxidant
[4)]Barium soap + sorbitan fatty acid ester 2. The method of claim 1, wherein said vehicle electrical equipment is a vehicle engine starter.

3. The method of claim 1, wherein said sliding parts and gears comprise a helical gear, a reduction gear, a drive shaft, and a lever.

4. The method for lubricating a vehicle electrical equipment of claim 1, wherein said grease composition comprises 50 to 95% by weight of component (A), 2 to 30% by weight of component (B), 0.1 to 20% by weight of component (C), and 0.1 to 20% by weight of component (D).

5. The method for lubricating a vehicle electrical equipment of claim 1, wherein said synthetic oil is selected from the group consisting of poly-α-olefins, hydrides of poly-α-olefins, diesters, polyol esters, alkylnaphthalene, alkylbenzene, polyoxyalkylene glycol, polyphenyl ether, dialkyl diphenyl ether, and mixtures thereof.

6. The method for lubricating a vehicle electrical equipment of claim 1, wherein said component (B) is a compound represented by the formula (1):

$$X—CONH—R^1—NHCO—Y \quad (1)$$

wherein $R^1$ stands for a divalent hydrocarbon group, and X and Y may be the same or different groups, each standing for $—NHR^2$, $—NR^3R^4$, or $—OR^5$, wherein $R^2$, $R^3$, $R^4$, and $R^5$ may be the same or different groups, each standing for a hydrocarbon group having 6 to 20 carbon atoms.

7. The method for lubricating a vehicle electrical equipment of claim 1, wherein said grease composition further comprises an additive selected from the group consisting of a solid lubricant, an extreme pressure agent, an anti-oxidant, a metal deactivator, an oilness agent, a rust-inhibitor, a viscosity index improver, and mixtures thereof.

8. A method for lubricating an engine starter comprising applying a grease composition to at least one of sliding parts and gears of an engine starter, said grease composition comprising:

(A) a silicon-free synthetic oil having a kinematic viscosity of 10 to 60 $mm^2/s$ at 40° C.;

(B) a thickener selected from the group consisting of urea compounds, urea-urethane compounds, urethane compounds, and mixtures thereof;

(C) melamine cyanuarate; and (D) polytetrafluoroethylene, and free of molybdenum disulfide.

9. The method for lubricating an engine starter of claim 8, wherein said grease composition comprises 50 to 95% by weight of component (A), 2 to 30% by weight of component (B), 0.1 to 20% by weight of component (C), and 0.1 to 20% by weight of component (D).

10. The method for lubricating an engine starter of claim 8, wherein said synthetic oil is selected from the group consisting of poly-α-olefins, hydrides of poly-α-olefins, diesters, polyol esters, alkylnaphthalene, alkylbenzene, polyoxyalkylene glycol, polyphenyl ether, dialkyl diphenyl ether, and mixtures thereof.

11. The method for lubricating an engine starter of claim 8, wherein said component (B) is a compound represented by the formula (1):

$$X—CONH—R^1—NHCO—Y \quad (1)$$

wherein $R^1$ stands for a divalent hydrocarbon group, and X and Y may be the same or different groups, each standing for $—NHR^2$, $—NR^3R^4$, or $—OR^5$, wherein $R^2$, $R^3$, $R^4$, and $R^5$ may be the same or different groups, each standing for a hydrocarbon group having 6 to 20 carbon atoms.

12. The method for lubricating an engine starter of claim 8, wherein said grease composition further comprises an additive selected from the group consisting of a solid lubricant, an extreme pressure agent, an anti-oxidant, a metal deactivator, an oilness agent, a rust-inhibitor, a viscosity index improver, and mixtures thereof.

* * * * *